United States Patent [19]

Drummond et al.

[11] Patent Number: 4,515,229

[45] Date of Patent: May 7, 1985

[54] DRILL BIT ASSEMBLY WITH FLUID SEPARATOR

[76] Inventors: Donald D. Drummond, 801 7th St. West, Jasper, Ala. 25501; Walter F. Johnsey, P.O. Box 1237, 831 First Ave., North, Birmingham, Ala. 35201; Roy W. Wood, 119 Persimmon St., Birmingham, Ala. 35214

[21] Appl. No.: 503,322

[22] Filed: Jun. 10, 1983

[51] Int. Cl.[3] ..... E21B 10/60

[52] U.S. Cl. ..... 175/337; 175/69

[58] Field of Search ..... 175/337, 339, 340, 393, 175/394, 324, 320, 243, 228, 69; 166/105.5; 55/203, 191

[56] References Cited

U.S. PATENT DOCUMENTS

| | | | |
|---|---|---|---|
| 1,710,606 | 4/1929 | Brady | 166/105.5 X |
| 2,634,101 | 4/1953 | Sloan | 175/324 |
| 2,920,872 | 1/1960 | Baur et al. | 175/69 |
| 3,029,881 | 4/1962 | Swart | 175/228 |
| 3,037,264 | 6/1962 | Mossberg | 29/106 |
| 3,048,230 | 8/1962 | Angel | 175/228 |
| 3,199,382 | 8/1965 | Andreasson | 77/72 |
| 3,359,837 | 12/1967 | Andreasson | 77/68 |
| 3,370,489 | 2/1968 | Andreasson | 77/72 |
| 3,401,758 | 9/1968 | Talbert | 175/337 |
| 3,511,120 | 5/1970 | Kaser | 77/68 |
| 3,543,613 | 12/1970 | Obloy | 77/72 |
| 3,561,299 | 2/1971 | Brisk et al. | 77/55 |
| 3,597,817 | 8/1971 | Whalley | 29/106 |
| 3,798,725 | 3/1974 | Hanson | 29/106 |
| 3,924,695 | 12/1975 | Kennedy | 176/69 |
| 4,080,091 | 3/1978 | Hollingshead | 408/60 |
| 4,154,313 | 5/1979 | Dysart et al. | 175/337 X |
| 4,168,925 | 9/1979 | Dufresne | 408/59 |

*Primary Examiner*—Stephen J. Novosad
*Assistant Examiner*—Thuy M. Bui
*Attorney, Agent, or Firm*—Dann, Dorfman, Herrell and Skillman

[57] ABSTRACT

In order to prevent the moisture in the general air supply from entering the first flow and generating mud in the area of the cones of a drill bit assembly, separator means is provided within the plenum chamber supported on the housing walls proximate to the conduit through which a first flow path flows. This may be done by using a stand pipe supported on an orifice plate of the first conduit and extending above the openings of a second conduit. Perforations in the stand pipe are above the second conduit. A fluid flow diverter at the end of the stand pipe is preferably of conical shape, larger diameter than the stand pipe and arranged so that its edges extend below some of the perforations on the stand pipe so that air entering the first flow must reverse course to pass through the perforations. Water cannot readily reverse in this manner. The larger second flow laterally out of the housing near the base of the plenum chamber below the stand pipe perforations is redirected away from the cutting cone but picks up the dust and cuttings fed to it by the first flow and carries them out of the drill hole.

Air for an air cooling and lubricating system for the bearings is taken from the plenum chamber above the diverter means and fed through channels to the bearings. The channel leading from the plenum may be shielded in the direction of fluid flow again to require air entering to reverse flow.

15 Claims, 3 Drawing Figures

DRILL BIT ASSEMBLY WITH FLUID SEPARATOR

BACKGROUND OF THE INVENTION

The present invention relates generally to drill bit assemblies and, more particularly, to such a drill bit assembly having a plurality of rotary cutting cones for use with a rotary drill for drilling into a relatively hard material, such as rock and the like.

DESCRIPTION OF THE PRIOR ART

Typical prior art rotary drill bit assemblies used for drilling into rock or other such relatively hard material comprise an elongated generally tubular housing or adapter sub to which is attached a bit which includes a plurality (generally three) of bearing mounted rotary cutting cones on the lower end thereof. The upper end of the adapter sub is adapted to engage for rotation a rotary drill, either directly or through the use of a suitable extension drill pipe when drilling deep holes. The adapter sub includes a central conduit which extends from the rotary drill (or the extension pipe) to the vicinity of the cutting cones. During the drilling operation, pressurized air from the rotary drill flows (either directly or via the extension pipe) through the central conduit in the adapter sub and is discharged downwardly either directly or through jet nozzles positioned between the rotating cutting cones. The discharged air impinges upon the rock or other such material being drilled and acts as a scavenging medium to pick up dust, cuttings and other such debris and carries them upwardly past the rotating cutting cones and out of the drill hole. Water or other such wetting agents may be added to the air flow continuously or intermittently as required to help control the dust generated by the drilling operation. A portion of the air flow may also be circulated by a second conduit through the cutting cone bearings to cool the bearings and to help prevent the entry of dust from the cuttings or other extraneous material into the bearings.

While the above-described prior art drill bits are relatively effective for drilling holes in rock and other such relatively hard materials, they suffer from certain operational drawbacks. It has been found that the high velocity air discharged from the central conduit reacts with the highly abrasive cuttings and dust from the bottom of the drill hole to, in effect, sandblast the cutting cones, thereby providing excessive wear and decreasing their useful service life. During those periods of time when water or any other such wetting agent is added to the air flow to control the release of dust, the water tends to accumulate in the bottom of the drill hole and form mud which impairs the removal of cuttings, clogs the bit and disrupts the drilling operation.

Our co-pending U.S. patent application Ser. No. 435,239, filed Oct. 19, 1982, entitled "Drill Bit Assembly", discloses a drill bit assembly which overcomes many of the drawbacks of the prior art by dividing the pressurized air flow in the adapter sub into two portions to provide a first downwardly directed flow of air to pick up and remove dust and cuttings from the vicinity of the cutting cones, and a second upwardly directed flow of fluid to scavenge the dust and cuttings away from the adapter sub and out of the drill hole. The present invention is a further improvement upon the drill bit assembly of the aforementioned patent application. In the present invention, a separator means is employed to separate out any moisture from the pressurized air which forms the first downwardly directed air flow. In this manner, the accumulation of water at the bottom of the drill hole is minimized.

SUMMARY OF THE INVENTION

Briefly stated, the present invention provides an improved drill bit assembly for drilling a generally circular hole into a relatively hard material, such as rock. The bit assembly comprises an elongated housing having a drill end adapted for attachment to a rotary drill and a tool end for receiving a tool having at least one cutting cone, for engaging and cutting a drill hole into the material to be drilled. A plenum chamber is located within the housing for receiving pressurized gaseous fluid from a fluid source. First conduit means is provided within the housing for directing a first flow of fluid from the plenum chamber out of the housing adjacent the at least one cutting cone into the drill hole and into impingement upon the material being drilled to pick up and remove along the housing dust and cuttings from the vicinity of the cutting cone. Separator means is supported within the plenum chamber on housing walls defined by that chamber proximate the first conduit means for separating moisture out of the first flow of fluid prior to the first flow entering the first conduit means. Second conduit means is provided within the housing for discharging generally, toward the drill end of the housing, a second flow of fluid out of the plenum chamber away from the cutting cone. The first flow of fluid is designed to be of sufficient magnitude for conveying dust and cuttings removed from the vicinity of the cutting cone into the second fluid flow, which is of sufficient magnitude to convey the dust and cuttings away from the bit assembly and out of the drill hole.

BRIEF DESCRIPTION OF THE DRAWINGS

The foregoing summary, as well as the following detailed description of the preferred embodiment of the present invention, will be better understood when read in conjunction with the accompanying drawings, in which.

DESCRIPTION OF A PREFERRED EMBODIMENT

Figure 1:
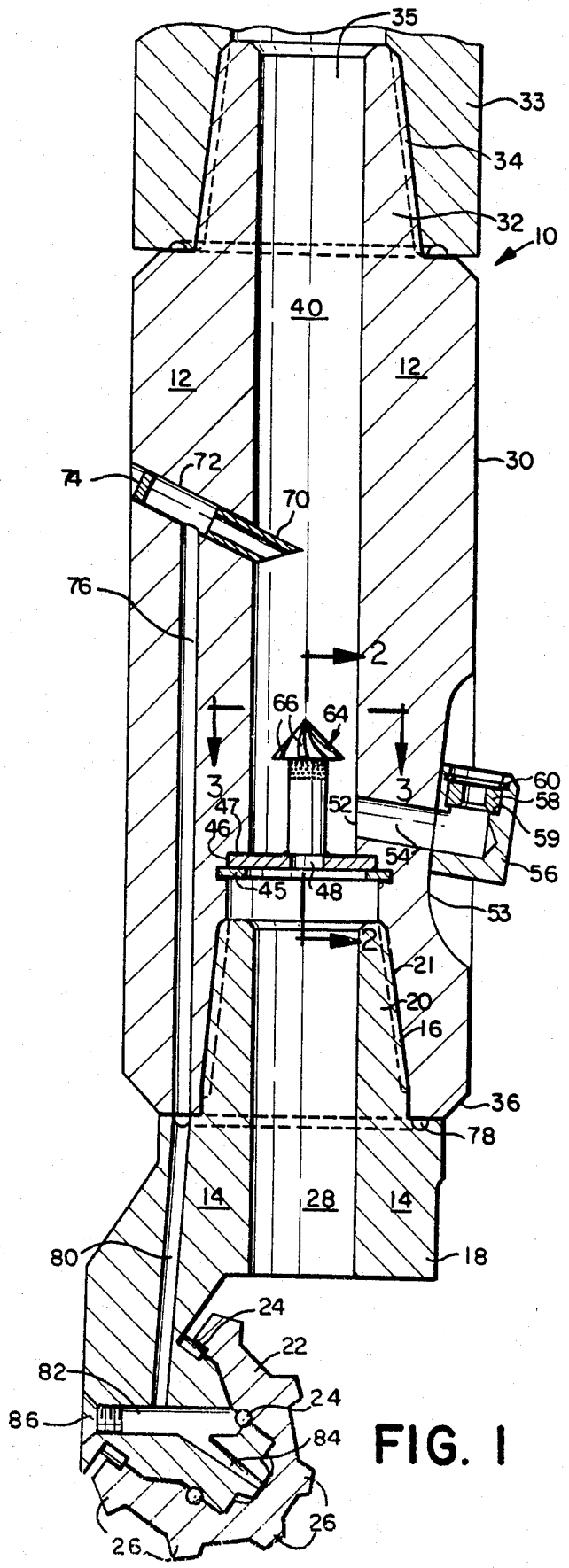
FIG. 1 is a transverse sectional view of a preferred embodiment of the drill bit assembly of the present invention.

Referring to the drawings, and particularly to FIG. 1, there is shown a sectional view of a preferred embodiment of a drill bit assembly, generally designated 10, in accordance with the present invention. A drill bit assembly of the type shown may be used in conjunction with a standard rotary drill (not shown) for drilling into relatively hard material, such as rock or the like (not shown) and has found particular application in connection with coal mining.

The drill bit assembly 10 is generally comprised of two major subassemblies; an adapter subassembly or "adapter sub" 12 and a bit subassembly or "bit" 14, which provides the cutting tool. The bit 14 comprises an irregularly shaped housing 18 having a frustoconically-shaped nipple 20 for engaging a complementary sized and shaped tapered socket 21 on the adapter sub 12 as shown. The nipple 20 and socket 21 are threaded as indicated at 16 to releasably secure the adapter sub 12 and the bit 14 to form a complete drill bit assembly 10.

The "bit" assembly housing 18 is adapted to rotatably support three rotary cutters or cutting cones 22 (only one of which is shown on FIG. 1 for purposes of clarity). The cutting cones 22 are each journalled for independent rotation upon bearings 24 which, in the present embodiment, comprise suitable anti-friction bearings. Suitable sealing means (not shown) may be provided to prevent debris from entering the area between the cutting cones 22 and the underlying supporting housing 18 and from contacting the bearings 24. The exterior surface of each of the cutting cones 22 may include a plurality of cutting teeth 26 which are employed for cutting into rock and other hard materials upon rotation of the drill bit 10 during the drilling operation. The teeth 26, as well as the other components of the cutting cones 22, are generally comprised of (or at least faced with) a relatively hard material such as tungsten carbide or the like. For purposes which will hereinafter become apparent, the bit housing 18 includes a generally cylindrically-shaped open conduit 28 extending centrally through from the end of the nipple 20 to the vicinity of the cutting cones 22.

Bit assemblies of the general type shown and described are well known in the art and may be purchased commercially in various configurations from several bit manufacturing companies, such as, Varel Manufacturing Company of Dallas, Tex. A more complete description of the detailed structure and operation of the conventional bit may be obtained from the manufacturer, if desired.

The adapter sub 12 is comprised of a generally cylindrically-shaped elongated housing 30 having a coaxial frustoconically shaped drill end 32. The drill end 32 of the housing may include suitable threading 34 and is adapted for engagement with drill pipe extension 33, usually through the intermediate rotary drill (not shown).

The adapter sub housing 30 includes a cylindrical bore 40 which extends coaxially through the housing 30 from the drill end 32 to the tool end 36 and provides the fluid retaining plenum chamber. During the drilling operation, pressurized fluid, usually compressed from a supply source of air under pressure (not shown) which is maintained within or located adjacent to the surface-mounted rotary drill drive (not shown), is supplied through series of pipes forming the connection to the drill bit assembly. As extension pipes 33 are added, the pressurized air is supplied through a suitable coupling to the pipes and to the bore of plenum chamber 40 of adapter sub housing 30. The pressurized air enters the plenum chamber 40 at the first housing end 32. The received air is thereafter distributed in a manner similar to, but somewhat modified from that described and claimed in our aforesaid copending U.S. patent application Ser. No. 435,239.

As in the situation of our earlier invention during the drilling operation, the amount of air exiting the plenum chamber 40 is determined by the size of opening of annular orifice 48. The orifice plate 46 is held in place against shoulder 47 by snap ring 45. Since only one orifice plate is used much reduced supply pressure may be used in this device, than in the aforesaid copending application structure. Flow through opening 48 results in a first air flow which enters the bit conduit 28 and whose pressure is very substantially reduced from that supplied to the plenum chamber 40. Much as in the prior art drill bits, the first flow is directed downwardly through a first conduit and is discharged between the cutting cones 22 for impingement upon the material being drilled. It will be observed that the structure at orifice 48 employs a modified structure, which will be explained below. The purpose of the first air flow exiting from the plenum chamber 40 is to cool the surface of the cutting cones 22 and to serve as a circulating medium to pick up and exhaust or remove dust and material cuttings from the drill hole in the vicinity of the cutting cones 22. The force of the first air flow serves to convey the cuttings and dust upwardly past the cutting cones 22 and around the outer surface of the drill bit 10 between the bit and the bore wall.

As discussed briefly above, in the prior art drill bits, substantially all of the air from the rotary drill passed at an unreduced pressure through the drill bit and impinged directly upon the material being drilled for the removal of dust and cuttings. It was the high pressure flow of substantially all of the compressed air in this manner which led to the sandblasting effect which caused premature wear of the cutting cones on the prior art drill bits. With the orifice plate construction described above and disclosed in aforesaid U.S. patent application Ser. No. 435,239, only a portion of the air from the plenum chamber 40 is directed through the orifice 48 into the first conduit to direct a first flow from the plenum chamber. This first flow leaves the housing adjacent the cutting cones to impinge upon the material being drilled for the removal of the dust and cuttings in the vicinity of the cutting cones 22. By reducing the pressure of the air impinging upon the material, the potential for damage to the cutting cones 22 caused by the sandblasting effect of the highly abrasive cuttings and dust has been greatly reduced from that of the prior art. As discussed below, first air flow out of the plenum chamber 40 needs only be of sufficient magnitude in quantity and velocity to pick up and remove the dust and cuttings from around the cutting cones 22 and to convey the dust and cuttings a short distance upwardly to be picked up and removed from the drill hole by a second flow, in a manner as will hereinafter be described.

Three passages 52 (only one of which is shown on FIG. 1) extend from the plenum chamber 40 through the housing 30 to provide second conduit means for discharging a second flow of fluid from the plenum chamber. In this embodiment, the passages 52 are disposed generally equidistantly from each other around the circumference of housing at a common axial level proximate to the annular orifice plate 46. Each passage 52 extending radially outwardly and slightly downwardly toward the bit. Three similar right angle elbow jet nozzle assemblies 56 (only one of which is shown in FIG. 1) for increasing the velocity of flow are each mounted on a flat surface normal to bore 54 in a niche 53 on the outer surface of the adapter sub housing 30. Each jet nozzle assembly has a jet producing orifice ring 58 seated on a shoulder 59 at its outlet and held in place with suitable fastening means such as a snap ring 60. The nozzles point generally toward the drill end 32 of the housing and direct the flow against the walls of the bore at a small angle for easy deflection.

During the drilling operation, air from the plenum chamber 40 flows through the second conduit means 52, through the passage 54 and the jet nozzle assemblies 56 and out of the jet nozzle orifices 58 toward the first drill end of the housing. The flow is confined between the walls of the drilled bore hole (not shown) and initially the walls of the housing 30, and thereafter the drill pipe extensions 33. Thus, confined and channelled upward, the flow of air exiting from the jet nozzle orifices 58 operates as a scavenging flow and picks up or combines with the above-described first air flow out of the plenum chamber 40 for further conveying the dust and cuttings removed from the vicinity of the cutting cones upwardly and out of the drill hole. By selection of relative orifice size of orifices 48 and 58, the relative amount of first and second flows of fluid may be adjusted. By, in effect, splitting the flow of air from the plenum chamber 50 in this manner, the first flow is kept at a low level in velocity and a quantity sufficient only to efficiently convey away the abrasive dust and cuttings from the drill bit 10 and out and up into the second flow resulting in a significant decrease in the sandblasting effect encountered by the cutting cones 22.

Figure 2:
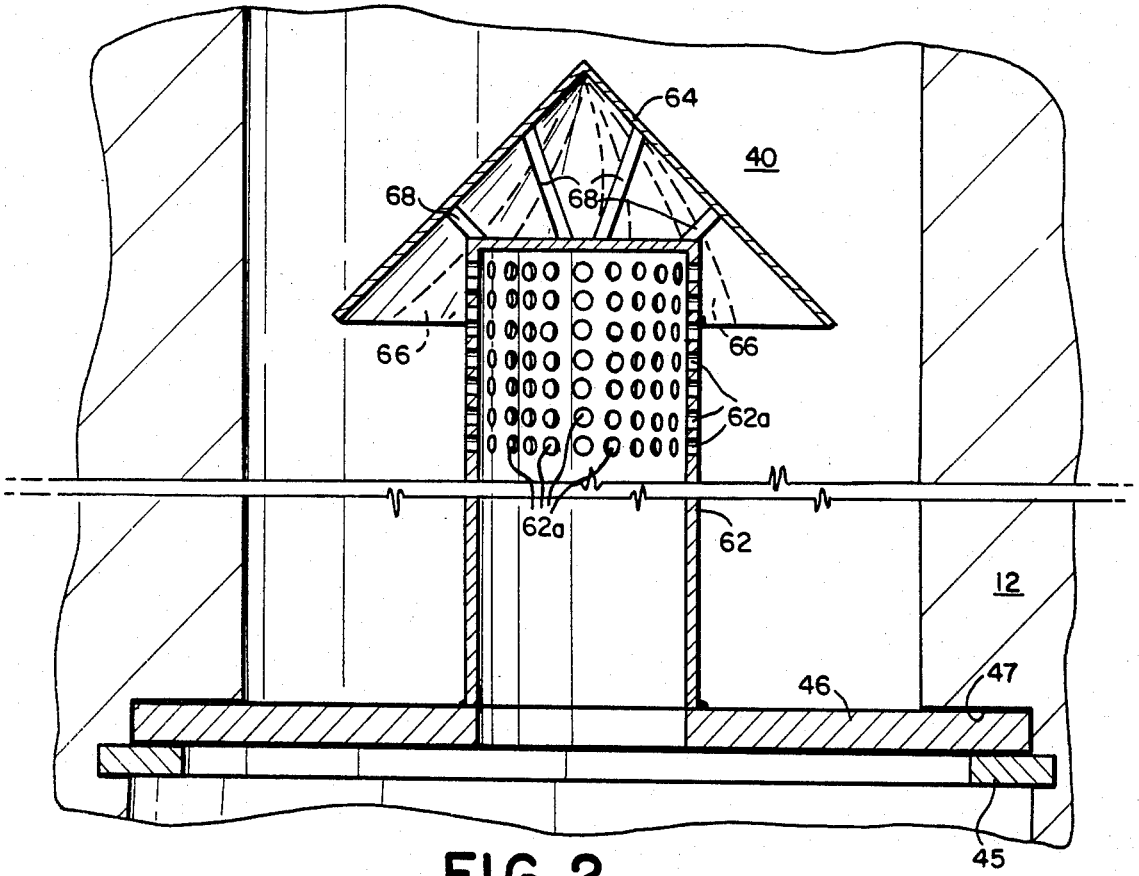
FIG. 2 is an enlarged sectional view of a portion of FIG. 1 taken along the section line 2—2 of FIG. 1.
Figure 3:
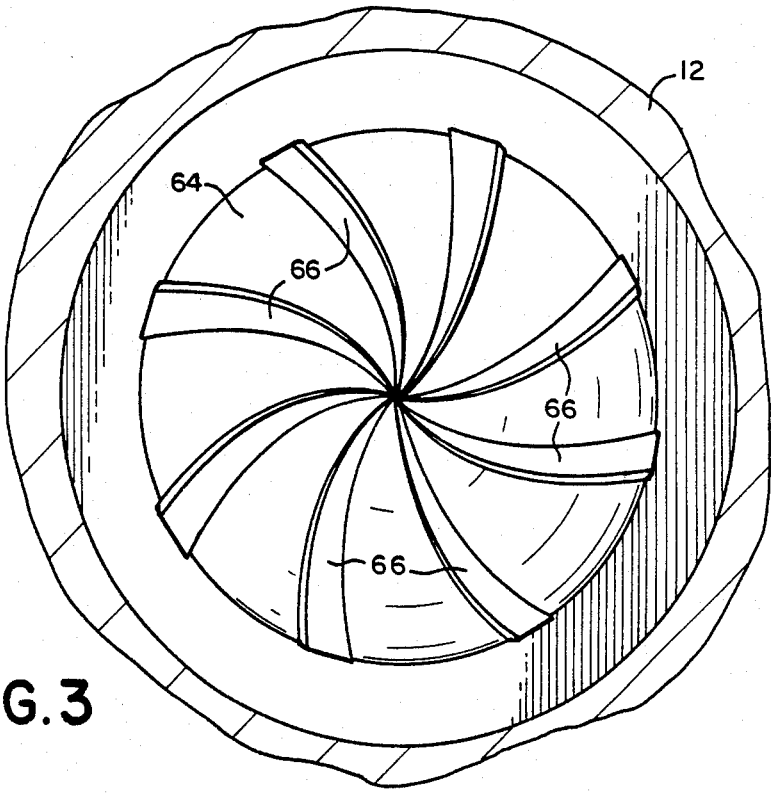
FIG. 3 is an enlarged sectional view of a portion of FIG. 1 taken along section line 3—3 of FIG. 1.

Referring now to the details shown in the enlarged views of FIGS. 2 and 3, seen in smaller scale in FIG. 1, the orifice in orifice plate 46 is covered by separator means having a stand pipe 62 which is cup shaped, to enclose the orifice and the standpipe projects into the plenum chamber 40. The stand pipe 62 is closed at its upper end but has a plurality of radial perforations 62*a* in several axial planes extending downwardly from the closed top. These perforations 62*a* permit the passage of pressurized air from the plenum chamber 40 through the orifice plate 46 and conduit 28 to the region of the cutting cones 22. Perforations 62*a* are oriented perpendicular to the flow of air through the plenum chamber and are of sufficient size and number not to reduce the flow of air through into the stand pipe and through the orifice plate 46 which would correspond to that which would be permitted by the relative orifice size of plate 46 and the size of the nozzles. However, it will be observed that the perforations in stand pipe 62*a* are remote from the orifice ring 46. Preferably located axially between the orifice plate 46 and the perforations 62*a*, the passages 52 permit formation of the larger volume of a secondary flow of air to provide the major conveying streams. Covering the closed end of the stand pipe 62 is a conical fluid deflector 64 arranged coaxially with the stand pipe. The edges of deflector 64 extend radially beyond the walls of the stand pipe 65, and axially below the closed end of the stand pipe. The deflector 64 serves at least the function of an air flow deflector and may also provide flow acceleration. The cover also may be flatter or steeper, employ various other shapes, such as oval, and employ various types of curved conical shapes instead of straight line elements. The conical face of the deflector is preferably provided with vanes or fins 66, which in this embodiment are shown in spiral or semi-helical arrangements and which tend to cause a spiralling or swirling of the pressurized air fluid as it moves past deflector 64 in the plenum chamber 40 and toward the passages 52. In the embodiment shown, the conical deflector 64 is supported relative to the closed end of stand pipe 62 by struts 68 which extend between and are fixed to the stand pipe and the deflector. The deflector 64 not only deflects the air coming toward the passages 52 but also, at the same time, due to the construction between the deflector 64 and the walls of the plenum chamber 40, produces an orifice effect. The orifice effect creates a centrifugal action on the air tending to cause the heavier water particles, which are in the air to provide a wetting agent to control dust generated by the drilling operation, as explained in the aforesaid copending application to precipitate out. The deflector 64 also necessitates a circuitous return of some of that air back to the perforations 62*a*. The deflector is placed so as not to obstruct those perforations 62*a* or otherwise impede the first flow of air through the orifice in plate 46.

What occurs is important to the present invention. Air molecules are freer than heavier water particles to make the turn back upwardly under the deflector 64 to form the first flow of air relatively free of water. This first flow of air passes through the perforations 62*a* and down through the stand pipe 62 and the orifice in plate 46 and through conduit 28. Consequently, air which is relatively free of water reaches the cutting areas and the tendency to form mud and otherwise clog the drilling area due to high moisture content is substantially reduced.

Air which may contain a considerable amount of water is more easily carried in the second flow of fluid out through the passages 52. In practice, water may tend to be precipitated out but during normal operation the rate of the second flow through passages 52 is such that no water accumulates in the plenum chamber adjacent the standpipe 62. However, there are times when flow is reduced or cut off, as when a new section of drill pipe is added, that water actually forms a pool between the walls of the plenum chamber 40 and the stand pipe 62 covering the orifice plate 46. The stand pipe 62 is designed so that its perforations are always above water level, although the possibility exists that water may rise high enough to enter the passages 52 which are placed below the perforations. However, that water is generally re-evaporated and carried outward by the second flow of air through passages 52 when drilling and the air supply is resumed.

Although it is not essential to the previously described aspects of the invention, it is sometimes also desirable to use air lubrication instead of oil lubrication for the bearings of the drill bit or tool. Air lubrication is accomplished by air taken in through air intake 70 or a plurality of similar intakes, into an associated passage 72. Each passage 72 is formed by a bore through the wall 12 of housing 30 from the plenum chamber to the outside, tilted from the radial away from the direction of flow into plenum chamber 40. A tubular member 70 placed within the bore 72 projects into the plenum chamber. Tubular member 70 may be cut on the bias to provide a deflector projecting into the plenum chamber 40. The deflector overhang allows the air moving into and through the plenum chamber to be deflected by the deflector portion of the tube 70 and requires the air to double back to turn into the tube 70. This allows air much more readily than water to turn into this devious course at tube 70, whereas, water-ladened air, or water particles, tends to go directly toward the bottom of the plenum chamber past tube 70.

Passage 72 is closed to the outer wall by a plug 74. The flow of air proceeds down a passage 76 parallel to the axis, or a plurality of similar passages, into a segmented ring passage 78, similar to that used for oil lubrication at the interface between housing 30 and bit subassembly 14 as described in the aforesaid copending application. The ring passage 78, in turn, feeds feeder passages 80, in the bit subassembly running generally parallel to the axis. Passages 80, in turn, feed main lubrication passage 82 and various spur passages 84 off of passage 82 to bearing regions needing lubrication and cooling. Passage 82 is formed by boring and is closed at the outside wall by a plug, such as a screw as shown. The air lubrication which is accomplished in this manner is accomplished with air which is relatively free in moisture.

The moisture in the air passing through the plenum chamber 40 is either carried directly out by the three streams constituting the second flow through passages 52 or is precipitated into a pool adjacent the standpipe 62 as previously described. Water in the pool is quickly reevaporated to be carried out by the three streams entering passages 52 (see FIG. 1) and thus is caused to bypass the cutting region of the tool. Therefore, moisture is not given a chance to cause problems by creating mud in the bottom of the bore hole and moisture problems are avoided in the working area of the drill bits, the cutting cones of the tools and the bearings thereof.

Lubrication by other schemes, of course, is possible and those disclosed in our above-identified application offer one possibility.

Other variations to structure disclosed in connection with the present application will occur to those skilled in the art. All such variations within the scope of the claims are intended to be within the scope and spirit of the present invention.

We claim:

1. A bit assembly for drilling into a hard material comprising:

an elongated housing having a drill end adapted for attachment to a rotary drill and a tool end for receiving a tool having at least one cutting cone for engaging and cutting a drill hole into material to be drilled;

a plenum chamber within the housing for receiving pressurized gaseous fluid of air and water from a fluid source;

pressure reducing means comprising a flow restricting orifice in the plenum chamber to provide a reduced pressure and reduced quantity of flow;

first conduit means communicating with said flow restricting orifice for receiving the reduced flow from the pressure reducing means and for directing the reduced flow from the plenum chamber out of the housing into the area of the cutting cone in the drill hole and into impingement upon the material being drilled to pick up and remove dust and cuttings from the vicinity of the cutting cones;

separator means supported within the plenum chamber on housing walls defining the plenum chamber in a position for separating water out of the flow of pressurized fluid prior to the pressurized fluid flow through the pressure reducing means; and second conduit means comprising at least one passage through the wall of the housing downstream of the separator means and above the orifice and having a nozzle outlet positioned for discharging a flow of the pressurized fluid toward the drill end of the housing and away from the cutting cone, the flow of gaseous fluid to pass through the second conduit means picking up the water separated by the separator means for exhaust through the second conduit means;

the relative sizes of the flow restricting orifice and the nozzle outlet being such that the first fluid flow is sufficient in quantity and velocity for conveying the dust and cuttings removed from the vicinity of the cutting cone into the second flow of fluid, and the second fluid flow is of a high velocity from the nozzle outlet and a quantity sufficient to combine with the first flow for conveying the dust and cuttings out of the drill hole.

2. The bit assembly of claim 1 in which the separator means includes fluid deflection means diverting the flow of gaseous fluid in the course of forming the first flow into a devious path which the air portion of the gaseous fluid is able to follow to enter the first conduit means but water particles are precipitated out, so that water will not enter the first conduit means.

3. The bit assembly of claim 1 in which the separator means consists of a standpipe blocking the first conduit means and extending back into the plenum chamber to close the orifice except for sufficient perforations to avoid impeding the air in the first flow of fluid, the perforations being in walled areas of the standpipe generally perpendicular to the fluid flow in the plenum chamber.

4. The bit assembly of claim 3 in which the stand pipe is supported on the pressure reducing means closing off the plenum chamber and providing an orifice for the first conduit means.

5. The bit assembly of claim 4 in which supported from the stand pipe is a fluid flow diverter of a larger diameter than the stand pipe in order to shield the perforations from the direct flow of fluid down the plenum chamber.

6. The bit assembly of claim 5 in which the stand pipe is coaxial with the plenum chamber and cylindrical, and the fluid flow diverter is supported coaxially before the stand pipe in the direction of fluid flow in the plenum chamber.

7. The bit assembly of claim 6 in which the fluid flow diverter carries means on the surface confronting the fluid flow in the plenum chamber for causing a centrifugal swirling of the fluid.

8. The bit assembly of claim 6 or 7 in which the fluid flow diverter is provided by a conical cap covering the unsupported end of the stand pipe and having means to engage the flow of fluid through the plenum chamber and cause centrifucal flow beyond the diverter.

9. The drill bit assembly of claim 6 in which the fluid flow diverter is generally conical and extends laterally beyond the periphery and below the unsupported end of the stand pipe in the direction of fluid flow in the plenum chamber.

10. The bit assembly of claim 9 in which the second conduit means consists of a plurality of generally radial passages through the wall of the housing from the plenum chamber and each passage having a jet nozzle outlet for jetting the flow of pressurized fluid and water upwardly between the housing and the walls of the drill hole, each such radial passage being positioned in the plenum chamber along the fluid flow before the orifice and after the fluid flow diverter.

11. The bit assembly of claim 1 in which a separate gaseous fluid lubrication channel is provided in the bit assembly for lubricating bearings for the drilling cones, the channel including at least one conduit from the plenum chamber through the housing wall and connected to the drilling cones.

12. The bit assembly of claim 11 in which the lubrication channel a connecting passage formed generally radial to but extending away from direction of fluid flow in the plenum chamber.

13. The bit assembly of claim 12 in which each passage of the lubrication channel extending into the plenum chamber is provided with a fluid flow diverting member which shields the passage in the direction of flow of fluid in the plenum chamber and requires gaseous fluid to flow beneath the shield and in the direction counter to the general fluid flow to enter the passage.

14. The bit assembly of claim 13 in which the fluid flow diverting member is a piece of tubing which is cut on the bias, supported in the passage of the lubricating channel to extend into the plenum chamber in such orientation as to provide shielding in the direction of fluid flow in the plenum chamber.

15. The bit assembly of claim 11 in which the intake for the gaseous fluid lubrication channel is located in the plenum chamber in the direction of fluid flow before the first and second conduit means.

* * * * *